United States Patent [19]

Maos

[11] 4,208,742

[45] Jun. 24, 1980

[54] COAT CONSTRUCTION WITH SEAMLESS SHOULDERS

[76] Inventor: Andreas M. Maos, 322 Pine St., Millbrae, Calif. 94030

[21] Appl. No.: 947,743

[22] Filed: Oct. 2, 1978

[51] Int. Cl.[2] ..... A41D 1/00

[52] U.S. Cl. ..... 2/93

[58] Field of Search ..... 2/93, 87, 268

[56] References Cited

U.S. PATENT DOCUMENTS

| | | | |
|---|---|---|---|
| 2,487,983 | 11/1949 | Robbins | 2/87 |
| 2,487,983 | 11/1949 | Robbins | 2/87 |
| 2,779,024 | 1/1957 | Storfer | 2/93 |
| 3,639,914 | 2/1972 | Ellman | 2/93 |

*Primary Examiner*—Werner H. Schroeder
*Assistant Examiner*—Doris L. Troutman
*Attorney, Agent, or Firm*—Thomas Schneck

[57] ABSTRACT

A garment construction for a coat in which a plurality of panels are sewn together, front and back torso panels being seamlessly connected at the shoulder, having been cut from a single piece of fabric. Similar left and right torso panels are longitudinally joined, together with left side and right side sleeve panels and collar panels to form a coat.

2 Claims, 3 Drawing Figures

COAT CONSTRUCTION WITH SEAMLESS SHOULDERS

BACKGROUND OF THE INVENTION a. Field of the Invention

The invention relates to garment construction and more particularly to a construction for coats, shirts and similar articles which have sleeves and a plurality of panels sewn together for covering the human torso.

b. Prior Art.

Previously, in coat construction, front and back torso panels were generally sewn together with a seam at the shoulder, as well as a seam on the side, below the arm hole. One of the problems with this type of construction is that for garments having patterns, there is a discontinuity at the shoulder seam which is noticeable and considered by some to be undesirable. Any attempt to match the pattern at the seam is time-consuming and increases the cost of the garment. For example, in most mens' suit coats of the type having a pin stripe pattern, no attempt is made to provide continuity of the pattern at the shoulder seam in most mass-produced garments.

An object of the invention was to devise a coat construction wherein pattern continuity is provided between front and back panels by avoiding a seam at the shoulder.

SUMMARY OF THE INVENTION

The above object is achieved in a construction for a coat, jacket, shirt or similar article wherein left and right side seamless torso panels are provided. Each of the torso panels has a front panel member and a back panel member seamlessly joined in a shoulder region thereof. Preferably, the front and back panels are full length, extending from the top of the shoulder to a region below the body midsection. The front panel is provided with an arm hole for connection of a sleeve. Preferably, the sleeve has a single longitudinal seam, as well as a seam for joining the sleeve to the arm hole.

The unitary construction of left and right side torso panels without seams in the shoulder region thereof permits the display of pattern continuity from front to back in the garment.

DESCRIPTION OF THE PREFERRED EMBODIMENT

Figure 1:
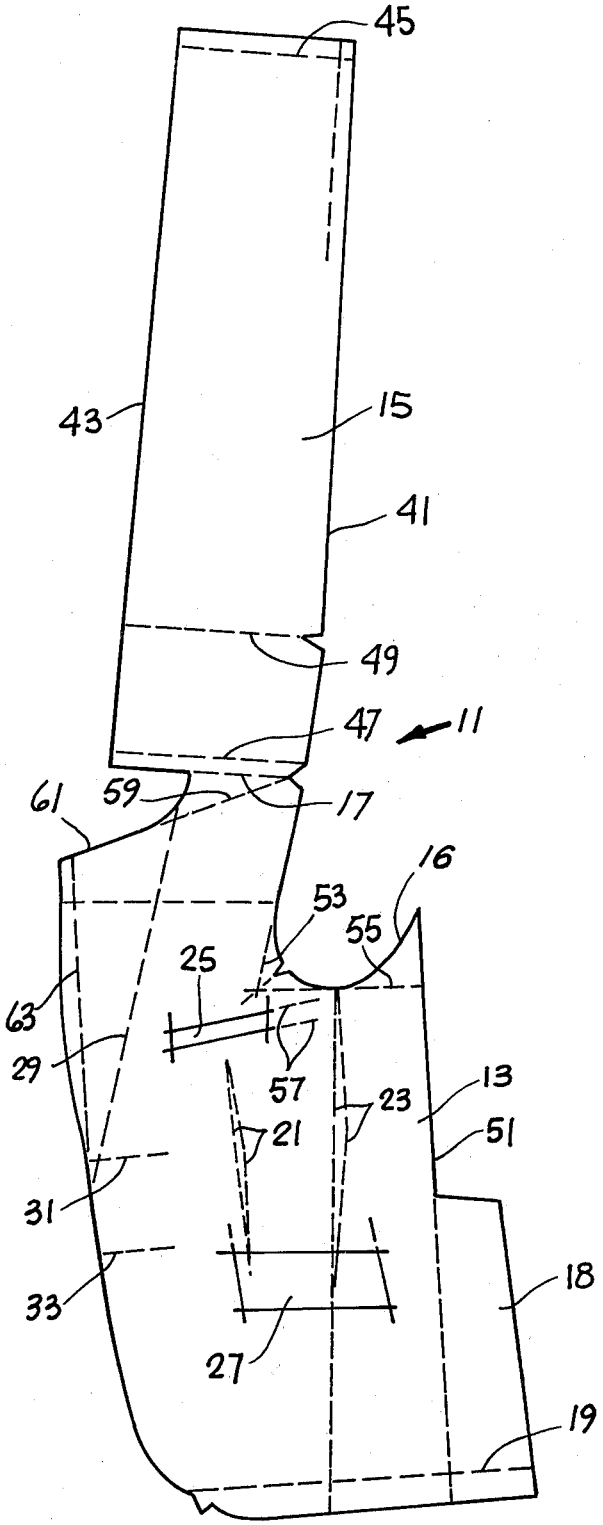
FIG. 1 shows a left side torso panel in accord with the present invention.

With reference to FIG. 1, a torso panel for construction of a man's suit coat is shown. The torso panel 11 is shown to include a front panel member 13 and a back panel member 15. The front panel member 13 has an elongated irregular shape with an arm hole 16 which is generally below the shoulder marking 17, indicated by a dashed line. The shoulder marking 17 is only used in tailoring and is not a seam or other visible structure which would be apparent in viewing the outside of the garment.

The lower part of the front panel member includes a lower vent quadrande 18 which extends down to the dashed line 19, marking the bottom of the coat. Fabric below the dashed line 19 is folded under and sewn back for appearance.

In the center of the front panel, it is customary to provide darts, indicated by the dashed lines 21, 23 for adjusting the coat to torso contours. Optional pockets 25, 27 may be provided. In the upper left region of the torso panel a lapel is formed by the dashed line 29 upon which the coat material is folded so that the material of the lapel to the left of dashed line 29 is doubled back partially covering pocket 25. Optional button hole areas may be placed at the base of the lapel, as indicated by the dashed lines 31, 33.

A generally rectangular rear panel member 15 is cut from fabric at the same time that the front panel member 13 is cut so that there is no seam in the shoulder region. The back panel member is preferably a full length panel, having a length which is generally equal to the front panel member extending from the top of the shoulder to below the body midsection. The right side of the back panel in FIG. 1 has a border 41 which is one of the longitudinal boundaries of the back panel and is generally aligned with the inside edge of the arm hole 16. The width of the back panel taken along a line generally perpendicular to the boundary 41 must be sufficient that corresponding back panels meet along a longitudinal seam defined by the boundary 43 and a corresponding boundary of a right side rear member of a torso panel similar to the one shown in FIG. 1. In practice, left and right side torso panels are cut at the same time by folding material, placing a pattern thereover and then cutting along the borders of the pattern. The drawing of FIG. 1 is an actual pattern for making the invention described herein.

For tailoring purposes, the length of the coat is measured from the dashed line 45 to the shoulder marking 17. Material above the dashed line 45 is folded under and sewn back for the sake of appearance. The shoulder marking 17 is placed at the base of the neck and is the first marking which is made. Approximately 2.5 cm. below the shoulder marking 17 a line for collar alignment is marked as indicated by the dashed line 47. Approximately 15 cm. further down the back of the garment another horizontal line is drawn, indicated by the dashed line 49 where there is a slight adjustment in the direction of boundary 41. This adjustment must be sufficient so that the upper portion of the back panel nearest the shoulder meets the shoulder hole for forming a round seam with a sleeve. On the other hand, the lowermost portion of the back panel 15 must have the boundary 41 aligned so that it meets the side seam 51 of the front panel 13. The intersecting dashed lines 53 and 55 are used to locate the arm hole 16 in the customary manner. The dashed lines 57 are used for locating optional pocket 25 so that the top of the pocket is in alignment with the lowermost portion of the arm hole. The dashed line 59 extends from the shoulder side boundary from the shoulder marking 17 on a line defining the top of the lapel and the beginning of the collar. A collar hole 61 is thereby defined and generally corresponds on one side to the dashed line 59 marking the top of the lapel and on the opposite side to the shoulder marking 17. The lapel has a dashed line 63 near its outward extremity where material is folded and sewn back for the sake of appearance.

Figure 2:
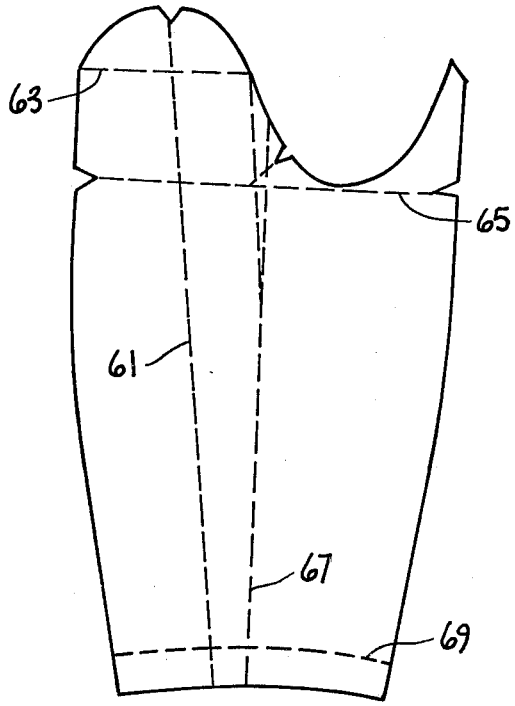
FIG. 2 shows a sleeve panel for joinder to the torso panel of FIG. 1.

With reference to FIG. 2, a one-piece sleeve panel is shown for joinder to the sleeve hole 16 in FIG. 1. The sleeve panel is formed by measuring the length of a sleeve from the top of the shoulder to the wrist region and marking it along a dashed line 61. The top and the bottom of the arm hole are marked by the dashed lines 63, 65. The dashed line 67 is laid out for longitudinal alignment with the longitudinal direction of the coat for purposes of pattern alignment. The dashed line 69 indicates the bottom of the sleeve and material beneath this line is folded under and sewn back for the sake of appearance.

Figure 3:
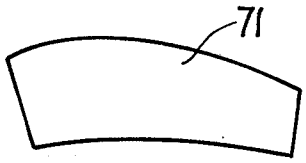
FIG. 3 shows a collar panel for joinder to the torso panel of FIG. 1.

With reference to FIG. 3, a collar panel 71 is shown which is combined with a corresponding collar panel and joined to the collar hole in FIG. 1. In the above description, the various dashed lines which are shown are preferably marked on a pattern which is used to make the coat or may be temporarily placed on the material itself, although in final construction the dashed lines are not apparent. They are used primarily for tailoring.

In this description, a man's coat is described but the present garment construction is applicable to ladies' coats, and to garments other than coats, such as shirts, jackets and the like.

What is claimed is:

1. A garment construction for a coat or similar article comprising, left and right side panels having a length for substantially covering a human torso, each torso panel having a front panel member and a back panel member seamlessly joined together at a transverse shoulder line, said back panel member being generally rectangular in shape with an upper lengthwise boundary thereof below the shoulder line defining a linear portion of an arm hole cut, said front panel member having a shoulder region defining an arm hole cut for attaching a sleeve, and left and right side sleeve panels, each having a length for substantially covering a human arm, said sleeve panels for attachment by means of a seam to the arm hole cut of respective left and right side torso panels.

2. The garment construction of claim 1 further defined by a collar cut, all of which is defined in said front panel member.

* * * * *